US005438825A

United States Patent [19]

Bloemers

[11] Patent Number: 5,438,825

[45] Date of Patent: Aug. 8, 1995

[54] AIR-COOLED ENGINE FOR POWERING PORTABLE EQUIPMENT

[76] Inventor: James L. Bloemers, 4814 General Scott Pl., Bossier City, La. 71112

[21] Appl. No.: 72,164

[22] Filed: Jun. 4, 1993

[51] Int. Cl.[6] ..... F01N 7/10

[52] U.S. Cl. ..... 60/272

[58] Field of Search ..... 60/282, 272, 317

[56] References Cited

U.S. PATENT DOCUMENTS

| | | | |
|---|---|---|---|
| 3,877,126 | 4/1975 | Deutschmann et al. . | |
| 3,958,418 | 5/1976 | Heidacker | 60/272 |
| 3,983,696 | 10/1976 | Pflugfelder . | |
| 4,031,699 | 6/1977 | Suga et al. . | |
| 4,050,244 | 9/1977 | Morikawa et al. . | |
| 4,096,690 | 6/1978 | Florek | 60/282 |
| 4,191,156 | 3/1980 | Doveri . | |
| 4,370,855 | 2/1983 | Tuggle | 60/317 |

*Primary Examiner*—Douglas Hart

[57] ABSTRACT

A portable, work prooducing apparatus is powered by a single cylinder, two-stroke, internal combustion engine made substantially from aluminum. An exhaust port defined through a wall of the cylinder has inserted therein a steel sleeve with dimensions smaller than the exhaust port to create an air gap between the sleeve and the walls of the exhaust port. A muffler is fastened directly to the cylinder at the exhaust port. Fastening of the muffler acts to press the flange of the sleeve against the exterior of the cylinder, thereby retaining the sleeve within the exhaust port without additional fasteners and creating a good seal with the muffler. The steel and air insulate very hot exhaust gases from the cylinder to prevent overheating of the air-cooled cylinder in the area around the exhaust port that causes premature failure of lubricant and wear of the engine components.

13 Claims, 3 Drawing Sheets

AIR-COOLED ENGINE FOR POWERING PORTABLE EQUIPMENT

FIELD OF THE INVENTION

The invention relates generally to exhaust systems for air-cooled engines used to power portable lawn and garden and forestry equipment.

BACKGROUND OF THE INVENTION

Space, weight and costs are critical considerations for forestry, lawn and garden equipment such as chain saws, line trimmers and blowers (generally referred to herein as portable power equipment) that are carried or handled by a consumer. Portable power equipment is thus typically powered with a two-stroke, single cylinder engine that is cooled by air blown across the cylinder. A muffler is directly fastened by bolts, springs or other retention devices to the exterior of the cylinder at an exhaust port defined through the wall of the cylinder. The engine is often enclosed to protect a user from the heat of the engine and to protect the engine from the oftentimes very dirty environment in which the equipment is being used. Air is blown through the housing by a flywheel fan. By placing the muffler on the downstream side of the cylinder, relatively more of the cylinder is exposed to the cooling air.

To reduce pollutant emissions from internal combustion engines, it is desirable to maintain the exhaust gases at relatively high temperatures. At high temperatures, unburnt fuel in the exhaust gases continues to combust after leaving the cylinder, thereby decreasing the amount of carbon monoxide and hydrocarbons emitted by the internal combustion engine.

Cylinders and exhaust systems that are much colder than the exhaust gases will cool the exhaust gases, resulting in less combustion in the exhaust gases and increased emission of pollutants. For example, during starting, the engine is cold. Thus, the exhaust gases initially lose much heat to the cylinder and are too cool for combustion. A liner fabricated from a quick-heating refractory material, such as that shown in U.S. Pat. No. 3,983,696 of Pflugfelder, reduces heat initially lost by the exhaust gases to the cylinder by rapidly heating and thereby reducing the temperature gradient between the exhaust gases and the material contacting the gases.

Similarly, in engines that are water-cooled, the coolant maintains the normal operating temperature of the cylinders at a relatively low level compared to the exhaust gases. The temperature of the exhaust gases consequently tends to be lowered to a point that is too cool for good combustion. A solution has been to insulate the exhaust gases from the cylinder by insulating the conduit from the exhaust port in the cylinder. Such solutions are shown, for example, in U.S. Pat. No. 4,031,699 of Suga et al. and U.S. Pat. No. 4,050,244 of Morikawa.

Generally, air cooled, two-stroke engines that power portable equipment do not have a problem with cold exhaust gases. The engine, and thus the exhaust gases, usually run hot, especially in warm weather when such equipment is used predominantly.

SUMMARY OF THE INVENTION

The invention addresses the problem of how to improve the longevity of lubricant and reduce the wear of single-cylinder air-cooled engines for portable power equipment. One major problem with air-cooled engines is that the surface area of the exhaust port opening is exposed to very hot gases leaving the cylinder. The area of the cylinder around the exhaust port thus becomes very hot. High temperatures cause lubricant in the cylinder to break down, causing premature wear. High temperature in one area of the cylinder also causes undesirable thermal stress in the cylinder.

The high heat conductivity of the cylinder, which is made almost entirely of aluminum, contributes to the problem. The aluminum construction, which lightens the engine, assists cooling by improving transference of the heat from the interior of the cylinder outwardly toward cooling fins on the cylinder. Ironically, the aluminum also tends to draw more heat from the exhaust gases passing through the exhaust port, making the cylinder hotter. Furthermore, dissipation of heat into the air from around the hottest spot on the cylinder is slowed or impeded by the muffler obstructing flow of cooling air past the wall of the cylinder around the exhaust port. The muffler, which can be very hot, also radiates heat and thus tends to slow dissipation of heat from the cylinder due its very close proximity.

Compounding the problem are the conditions under which the equipment often operates. Dirt and other debris clogs inlets to the fan and settles on the cooling fins of cylinder during a hot summer day. This dirt interferes with air flow and thus the cooling of the rest of the cylinder, further degrading heat dissipation through the cylinder from the area around the exhaust port.

To overcome the problem and yet keep within the size, weight and cost restraints imposed on lawn and garden implements, the invention is an improved air-cooled, single-cylinder internal combustion engine for powering portable equipment, particularly forestry, lawn and garden equipment with reduced temperatures around the exhaust port. Lubricant longevity is improved and wear is reduced.

According to a preferred embodiment of the invention, a single cylinder engine has a muffler attached directly to the cylinder at an exhaust port. A one-piece sleeve is inserted into the exhaust port opening during assembly of the engine. The sleeve is offset inwardly from the interior surface of the exhaust port, thus forming an air gap around the sleeve and the cylinder. The material of the sleeve and the air have coefficients of heat transfer less than the material of the cylinder, thus slowing the rate of transfer of heat of the exhaust gases to the cylinder. The muffler is then fastened to the cylinder, resting against the sleeve so that the sleeve is retained within the exhaust port.

The invention has several advantages. The temperature of the area of the cylinder adjacent the exhaust port tends to be cooler, reducing the deleterious effects of heat on the lubricant and wear of the cylinder. The sleeve is very easy to install during assembly of the device. Only one additional step is required to insert the sleeve into the exhaust port prior to fastening of the muffler, and no additional retention devices or parts are required. Heat absorbed by the insert tends to be transferred to the muffler. The sleeve adds practically no size and very little weight to the equipment. Furthermore, little modification to existing portable power equipment is required, only the exhaust port profile is changed.

The disclosed embodiments have several additional inventive aspects and advantages.

A flange circumscribing the outside opening of the sleeve, extending between the muffler and the cylinder, serves several purposes. It assists in sealing the muffler to the sleeve and retaining the sleeve within the exhaust port. More importantly, in cooperation with a projecting lip on the cylinder around the exhaust port opening, the lip centers the insert within the exhaust port opening to minimize contact between the insert and the inner wall of the exhaust port. Tightly retaining the muffler against the insert prevents movement or dislodging of the insert by considerable vibrational forces experienced by the engine during operation without use of any additional retention components or fasteners.

The sleeve insert can be stainless steel so that it is corrosion resistant, but corrosion resistance is not a requirement. It also may be used in combination with a heat shield placed between the muffler and the cylinder.

The foregoing summary is intended only to provide a general indication of the inventive aspects of the disclosed embodiments and in no way limits the scope of what is claimed as the invention. Additional inventive aspects and advantages are set forth in or will be readily apparent from the following description of the preferred embodiment of the invention.

DETAILED DESCRIPTION OF THE PREFERRED EMBODIMENT

Figure 1:
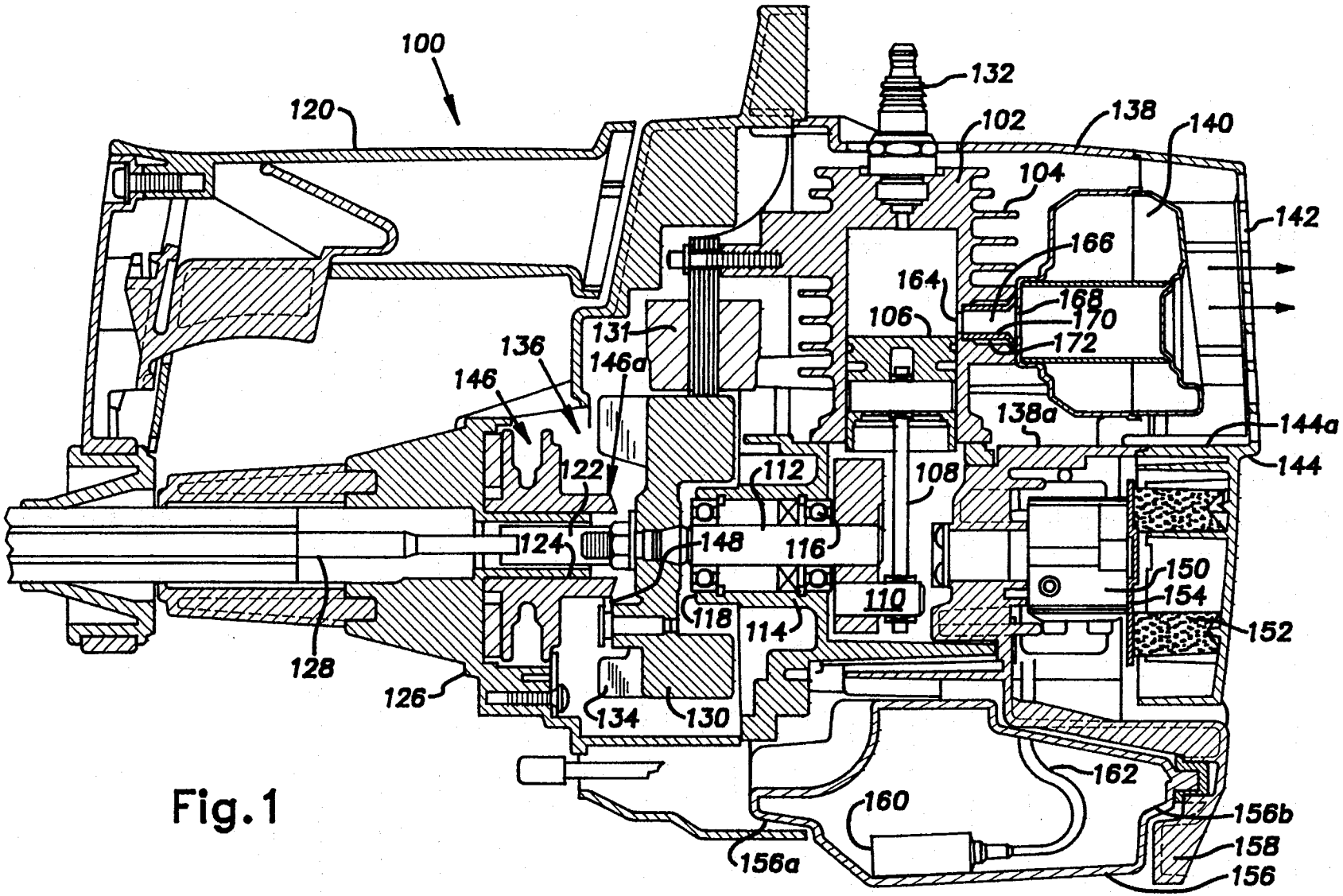
FIG. 1 is a cross-section of a power head for a trimmer sectioned through its center, with several components not shown in section.
Figure 2:
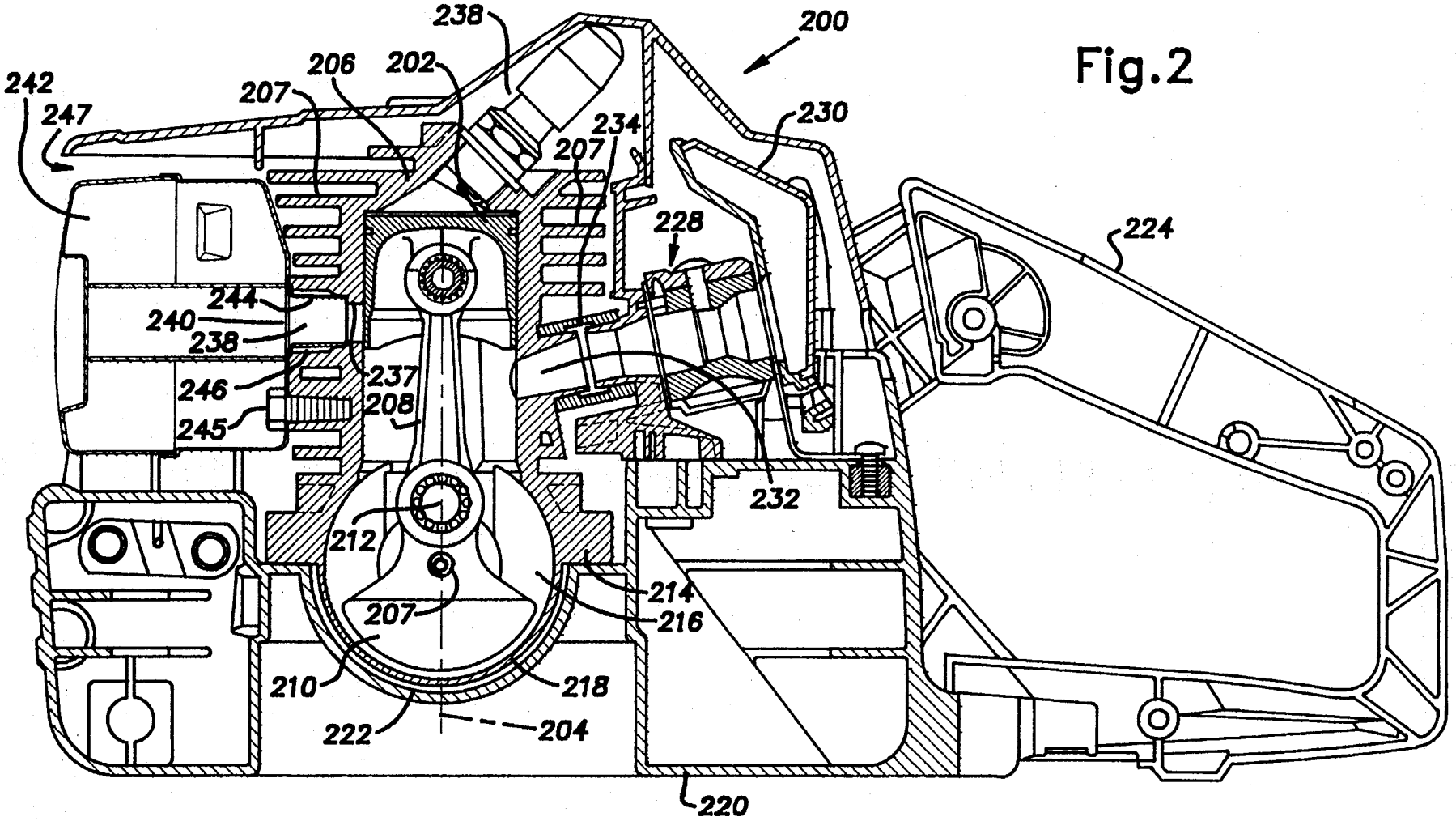
FIG. 2 is a cross-section of power head for a chain saw with several components not shown in section.

FIGS. 1 and 2 are power heads for driving cutting apparatus, particularly a flexible line trimmer and a chain saw, respectively, and are intended to be representative of power heads for producing work on lawn and garden, forestry and portable equipment in general that are powered by single cylinder, air cooled internal combustion engines. Examples of such equipment are line trimmers, blowers, hedge trimmers, edgers, lawn mowers, chain saws, snow throwers, etc.

Referring to FIG. 1, the line trimmer power head 100 is powered by a two stroke and air cooled internal combustion engine. It includes a cylinder 102 provided with a plurality of externally disposed cooling fins 104. A piston 106 is mounted for reciprocal movement within the bore of the cylinder in the conventional manner and is coupled through connecting rod 108 to crank pin 110. According to this arrangement, reciprocal movement of the piston 106 within the bore of the cylinder 102 is translated into rotation of a crankshaft 112.

Crankshaft 112 is supported in a cantilevered manner for rotation within crankcase 114 by bearings 116 and 118. The cantilevered configuration is more economical to manufacture and easier to assemble than a conventional balanced crankshaft. It also is comparatively shorter than balanced crankshafts, permitting a more compact arrangement of components and better balance, placing the heaviest components of the engine closer to the handle 120. The forward end of crankshaft 112 is connected to a coupling member 122 that is carried for rotation within a shaft 124 integrally formed in blower housing 126. The coupling member includes a keyhole that receives a flat end of drive shaft 128 to couple the drive shaft to the crankshaft for rotation.

Flywheel 130 is attached to the forward end of the crankshaft, before the coupling member, and rotated by the crankshaft. Flywheel 130 includes a permanent magnet which is magnetically coupled in a conventional manner to solid state ignition module 131 for developing ignition current. The ignition current is applied to the electrodes of a spark plug 132. A plurality of blades 134 are secured to the flywheel 130 to form an impeller of a radial flow centrifugal fan. When the flywheel 130 rotates, cooling air is drawn into the center of the fan through air intake openings 136 and then radially out along its periphery under pressure. A scroll-shaped involute for the impeller, not shown in the cross-section, is formed by walls extending from the interior surface of blower housing 126. The involute discharges a stream of cooling air upwardly within the blower housing and into the engine housing 138. The stream is forced to pass first over the cooling fins 104 found on the exterior of cylinder 102 and then past muffler 140, cooling first the cylinder and then the muffler. The muffler is fastened or retained against the cylinder by a pair of springs, not seen, in the conventional manner. The cooling air then exits the engine housing, mixed with exhaust gas discharged from the muffler, through ventilation openings 142 in rear housing 144, away from the operator and the operator's hands. The mixed gases tend to be cooler than just the exhaust gas.

A recoiling starter pulley assembly 146 is carried for rotation on shaft 124. A rope (not shown) is wound about the starter pulley. A spring (not shown) applies a biasing force to rotate the pulley to recoil the rope on the pulley in a conventional manner when not being pulled. The starter pulley includes a ratchet portion **146*a* that is coaxial with shaft 124. The ratchet has inclined teeth that conventionally formed which extend laterally outwardly from its circumference and into which dawg 148 drops for imparting rotation in only one direction. Dawg 148 is attached to a flywheel 130** for pivoting and is biased with a spring to pivot inwardly toward the axis of rotation of the flywheel to engage the ratchet. Centrifugal forces generated when the flywheel is rotating at normal engine operating speeds retracts the dawg from the ratchet. The starter is thereby coupled to the crankshaft only during starting, and disengages once the engine is running.

A carburetor 150 (not shown in section) is mounted to an open end of the crankcase 114, opposite the crankshaft 112 and to the rear of the trimmer, and aspirates the crankcase in a conventional manner. Air filter 152, generally rectangular in shape, is mounted in rear housing 114 and is firmly pressed against plate 154 surrounding the throat (not seen) of the carburetor. Air is drawn into the filter housing between the outer periphery of plate 154 and peripheral flanges of the rear housing around the filter. The air then passes through the filter and into the carburetor. Air filter 152 also tends to silence the noise normally associated with air intake into a carburetor. Interior wall **144*a* of the rear housing 144 and interior wall 138*a* of engine housing 138 form a thermal barrier that in addition to directing the flow of cooling gas, help shield the carburetor from heat radiating from the muffler 140** and cylinder during operation.

Fuel tank 156 is generally elongated and mounted below crankcase 114 and carburetor 150. Retention of the tank is accomplished without fasteners. A tongue-shaped forward extension of fuel tank 156*a* is received within a lower flange portion of blower housing, and rear flange portion 156*b* is received within a clamp extension 158 of engine housing 138. Fuel from the tank is drawn through filter 160 and delivered to the carburetor through fuel line 162.

The top edge of piston 106 controls the opening and closing of a window 164 to exhaust port 166. The exhaust port is coupled directly to the inlet 168 of muffler 140. The muffler is fastened in a conventional manner directly to the cylinder by springs on each side of the muffler (not shown) that pull the muffler toward the cylinder. The exhaust port is lined with sleeve 170 of steel. The sleeve is spaced inwardly from the wall of the exhaust port to form an air gap 172 circumscribing the sleeve. The sleeve and the air gap have lower coefficients of heating than the cylinder, which is almost purely aluminum. The sleeve and air gap thus act as insulators, slowing the rate of heat transference from the exhaust gases to the cylinder wall.

Referring to FIG. 2, illustrating a power head 200 for driving a chain saw, piston 202 reciprocates along axis 204 within the bore of cylinder 206 in a conventional manner. Cylinder 206 is made almost purely from aluminum. Aluminum is lightweight and conducts heat well, helping to move the heat away from the interior of the cylinder and out to cooling fins 207 that are located on the outside of the cylinder. The reciprocating movement of piston 202 is translated into rotation of a crankshaft about axis 204 by rod 208 turning crank pin 212. The crankshaft is obscured by counter weight 210 and pin 212. Integrally formed with cylinder 206 is a top portion 214 of crankcase 216. The bottom portion 218 of the crankcase sits within a saddle 222 formed within lower housing 220. A right side half of rear handle 224 is integrally formed with a lower housing 220.

The carburetor receives air through the air filter element. Clean, pressurized air can be scooped from a blower on the side of the power housing which cannot be seen and delivered to the box via a duct that cannot be seen. The engine is aspirated through the crankcase. Therefore, the carburetor delivers a fuel-air mixture to the crankcase 210 through port 232. Flexible tube 234 connects the carburetor to a lip surrounding the port. The lower edge of the cylinder opens and closes the window of the port into the crankcase in a conventional fashion. Fuel and air are drawn into the crankcase by the low pressure created during upward travel of the piston. A channel is formed in the side of the cylinder through which a charge of fuel and air is transferred from the crankcase to the cylinder. The top edge of the piston, when it is near the bottom of its downward movement following combustion, opens the transfer channel. The bottom edge of the piston also closes port 232 to the crankcase at substantially the same time, sealing the crankcase. Downward movement of the piston thus pressurizes and subsequently displaces the charge from the crankcase through the opened transfer port to scavenge the cylinder. A spark plug 238 provides the spark to ignite the fuel/air mixture.

The top edge of the cylinder also controls the opening and closing of a window 237 to exhaust port 238. The exhaust port is coupled directly to the inlet 240 of muffler 242. The muffler is fastened directly to the cylinder using bolts 245. Other types of fasteners or retention methods, such as springs, may also be used. The exhaust port is, like that of the engine shown in FIG. 1, lined with a steel sleeve 244. The sleeve is spaced inwardly from the wall of the exhaust port to form an air gap 246 circumscribing the sleeve. The sleeve and the air gap have lower coefficients of heating than the cylinder, which is composed almost purely of aluminum. The sleeve and air gap thus act as insulators, slowing the rate of heat transference from the exhaust gases to the cylinder wall.

The power head 200 includes an integrally formed flywheel impeller or fan that is rotated by the crankshaft. The discharge of the fan is directed upwardly from a point generally below and rearward of the cylinder, past first the plurality of cooling fins 207 and then out through an opening 247 in the front of the upper housing. The air first picks up heat from the cylinder and then the muffler, before it is carried out the front with exhaust gases from the muffler.

Figure 3:
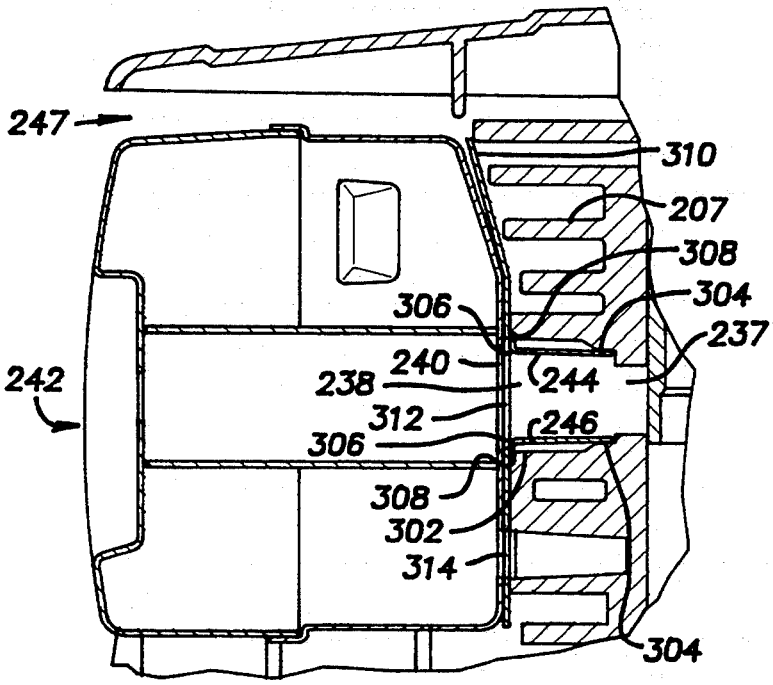
FIG. 3 is a cross-section of a detail of the power head of FIG. 2 showing a muffler, exhaust port insert and heat shield.

Referring now to FIG. 3, a detail of FIG. 2 is shown for purposes of showing details relating to sleeve 244. These same details are also present in sleeve 170 in FIG. 1. The sleeve tapers very slightly inwardly in the direction of timing window 237 of the exhaust port. A portion 302 of the exhaust port, near the outer surface of the cylinder, has a larger dimension than the sleeve to form air gap 246. The walls of the sleeve are substantially parallel to the flow of exhaust gas. Near the window, a portion 304 of the port narrows to the dimension of the outer surface of the sleeve so that a portion of the length of the walls of the sleeve contacts the surface the portion 304 of the port to create a good seal while allowing relatively easy and simple insertion of the sleeve during assembly. Slightly tapering the inner surface of portion 304 helps to achieve a more snug fit. A gas seal prevents exhaust gases from escaping into the air gap 246. The inner surface of the sleeve is below the edges of the window to avoid creating undue impediments to the flow of exhaust from the window that increase back pressure.

The outer end of the sleeve 244 includes a turned portion that forms a flange or lip 306. The lip, when the sleeve is inserted into the exhaust port, fits within an inset or shoulder 308 formed around the outlet of the exhaust port. The lip cooperates with the inset to preserve proper relationship of the sleeve with the exhaust port, which is necessary due to the vibration of the engine while running. The lip also has a slightly larger thickness than the depth of inset 308 to form an interference fit that provides a proper seal between the sleeve and the muffler and ensures that the insert remains tight within the exhaust port. The inner portion of the sleeve does not extend all the way to the outer side of the window 237. This allows some tolerance in its length to ensure that the lip portion fits squarely within the inset.

The sleeve is a unitary piece that is easily fabricated according to well-known methods. The exhaust port also is fabricated according to well-known methods. During assembly, the sleeve is manually inserted into the exhaust port and the muffler fastened to the cylinder in a conventional manner, using any one of numerous retention methods. If the muffler is held by springs, a lip around the muffler inlet 240 can be used to extend into the inside of sleeve 244 so that muffler does not slip and proper alignment is maintained. The sleeve can be used with a wide range of mufflers. Each muffler requires fitting of inlet 240 to the exhaust port and therefore can provide the necessary force to retain the sleeve within the exhaust port. Furthermore, if the sleeve becomes corroded, due to the high temperatures and composition of exhaust gases, it is can be replaced easily and without great expense.

A heat shield 310 placed between the muffler and the cylinder reduces the effects on the cooling of the cylinder of heat radiated from the muffler. The shield is normally made of aluminum for good heat dissipation, but can be made from other material if desired. It includes an exhaust opening 312 that is aligned during assembly with the exhaust port and the muffler inlet 240 to allow passage of the exhaust. The surface of the heat shield is no larger than the muffler so that it does not obstruct flow of cooling air past the cylinder and muffler. The heat shield is easily installed during assembly and requires no additional fasteners. If bolts are used to retain the muffler against the cylinder, the bolts go through a hole 314 formed in the heat shield. Alternately, lips around the muffler inlet 240 and extending outwardly through exhaust opening 312 of the shield to engage the inside of the sleeve, and will retain the proper alignment of the sleeve, exhaust opening 312 and muffler inlet 240.

Figure 4:
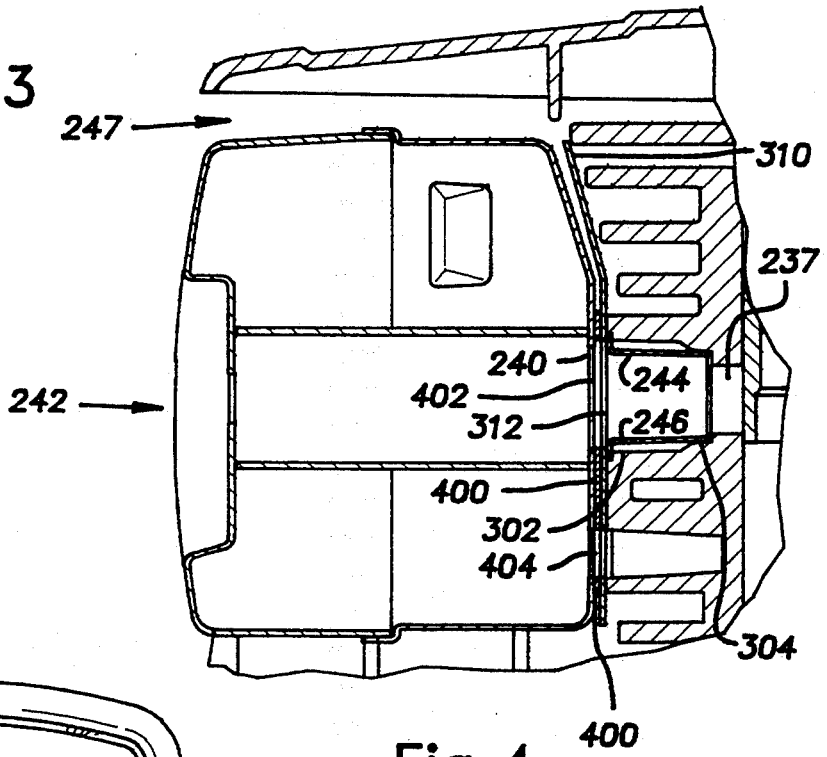
FIG. 4 is a cross-section of a detail of the power head of FIG. 2 showing the muffler, exhaust port insert, heat shield and space between the muffler and heat shield.

Referring now to FIG. 4, the heat shield 310 is spaced apart from the muffler by an insulator or gasket 400 to introduce a layer of air between the muffler and the shield that slows the transmission of heat. This further improves cooling of the cylinder. The gasket is made from steel, but can be made from other materials, preferably ones that provide some degree of insulation. It includes an exhaust opening 402 and an opening 404 for a bolt.

Figure 5:
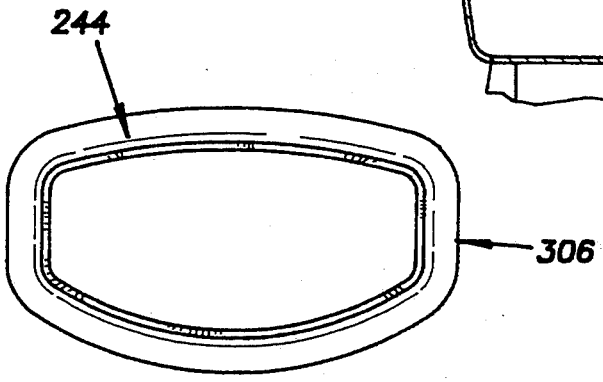
FIG. 5 is a rear elevational view of the exhaust port insert.

Referring now to FIG. 5, sleeve 244 is shown in elevation from its rear.

Only the preferred embodiments of the invention of been described to illustrate the invention. Numerous modifications, rearrangements and substitutions could be made to the disclosed embodiments without departing from the spirit of the invention, the scope of which is indicated by the appended claims.

What is claimed is:

1. A hand-held, portable work producing apparatus powered by an internal combustion engine comprising:

a work producing component positionable by a handle manipulatable by a person;

an air-cooled combustion engine coupled to provide a motive force to the work producing component, the engine including a cylinder made substantially from a metal that is lightweight and provides good heat conductivity, the cylinder having an exterior surface with a plurality of cooling fins across which air is blown for cooling the engine, the cylinder including a wall through which an exhaust port is defined for transferring gases after combustion from inside the cylinder to a muffler adjoining the exterior of the cylinder;

a unitary sleeve made of a material having less heat conductivity than the metal of the engine, the sleeve being inserted into the exhaust port from the exterior of the cylinder, said sleeve including a flange that extends outwardly from the walls of the sleeve and is in contact with the exterior of the cylinder when the sleeve is fully inserted in the exhaust port, said flange allowing an outer seal to form between the muffler and the sleeve and permitting the muffler to retain the sleeve securely within the exhaust port;

said muffler being adjacent to and retained against the cylinder by fastening means, the muffler having an inlet coupled to the exhaust port for receiving exhaust gases and acting to retain the sleeve securely within the exhaust port without any additional fastening means for the sleeve;

wherein the inner surfaces of the exhaust port narrow near the inside of the cylinder to the dimension of the sleeve so that a portion of the sleeve contacts the surfaces of the exhaust port near the inside of the cylinder to form an inner seal between the sleeve portion and the exhaust port that tends to withstand the vibrational forces of the engine, wherein the sleeve is dimensioned such that walls of the sleeve between said sleeve portion and said flange are spaced apart from inner surfaces of the exhaust port to create an air gap between the sleeve and the inner surfaces of the exhaust port, the inner seal preventing exhaust gases from escaping into the air gap.

2. The apparatus of claim 1 wherein the exhaust port includes an exterior surface having a recess set therein around the opening of the exhaust port to the exterior of the cylinder in which the flange is inset when retained by the muffler and with which the flange cooperates to maintain the sleeve in spaced relationship from the inner walls of the exhaust port.

3. The apparatus of claim 1 further including a heat shield interposed between the muffler and the cylinder, the heat shield having a hole defined therein to allow exhaust gases to flow from the exhaust port and into the muffler; wherein the sleeve is retained within the exhaust port by the heat shield.

4. The apparatus of claim 3 further including a spacer having an opening surrounding the flow of exhaust between the heat shield and the muffler for spacing apart the heat shield and the muffler.

5. The apparatus of claim 1 wherein the exhaust port includes a timing window to the inside of the cylinder, and wherein the exhaust port and the sleeve have dimensions larger than dimensions of the timing window such that the end of the, sleeve near the inside of the cylinder does not obstruct flow of exhaust gases through the timing window and into the exhaust port.

6. The apparatus of claim 1 wherein the engine is made substantially from aluminum and the sleeve is made from steel.

7. A hand-held, portable work producing apparatus powered by an internal combustion engine comprising:

a work producing component positionable and manipulatable by a person;

an air-cooled combustion engine coupled to provide a motive force to the work producing component, the engine including a cylinder made substantially from aluminum to be lightweight and to provide good heat conductivity, the cylinder having an exterior surface with a plurality of cooling fins across which air is blown for cooling the engine, the cylinder including a wall through which an exhaust port is defined for transferring gases after combustion from inside the cylinder to a muffler adjoining the exterior of the cylinder;

a unitary sleeve made of a material having less heat conductivity than the metal of the engine, the sleeve being inserted into the exhaust port from the exterior of the cylinder and having a smaller dimension than said exhaust port so that walls of the sleeve are spaced apart from interior surfaces of the exhaust port to create an air gap between the sleeve and the interior surfaces of the exhaust port; and said muffler being adjacent to and retained against the cylinder by fastening means, the muffler having an inlet coupled to the exhaust port for receiving exhaust gases and acting to retain the sleeve securely within the exhaust port without any additional fastening means for the sleeve;

wherein the sleeve includes a flange that extends outwardly from the walls of the sleeve and is pushed against the exterior of the cylinder when the sleeve is fully inserted within the exhaust port, the flange allowing a good seal to form between the muffler and the sleeve while permitting the muffler to retain the sleeve securely within the exhaust port.

8. The apparatus of claim 7 wherein the inner dimensions of the exhaust port narrow to the dimension of the sleeve so that a portion the length of the sleeve contacts the narrowed dimension to form a seal between the sleeve and the exhaust port that tends to withstand the vibrational forces of the engine, the seal preventing exhaust gases from escaping into the air gap.

9. The apparatus of claim 7 wherein the exhaust port includes an exterior surface having a recess set therein around the opening of the exhaust port to the exterior of the cylinder in which the flange is inset when retained by the muffler and with which the flange cooperates to maintain the sleeve in spaced relationship from the inner walls of the exhaust port.

10. The apparatus of claim 7 further including a heat shield interposed between the muffler and the cylinder, the heat shield having a hole defined therein to allow exhaust gases to flow from the exhaust port and into the muffler; wherein the heat shield acts to retain the sleeve within the exhaust port by the heat shield.

11. The apparatus of claim 10 further including a spacer having an opening surrounding the flow of exhaust between the heat shield and the muffler for spacing apart the heat shield and the muffler.

12. The apparatus of claim 7 wherein the exhaust port includes a timing window to the inside of the cylinder, and wherein the exhaust port and the sleeve have dimensions larger than dimensions of the timing window such that the end of the sleeve near the inside of the cylinder does not obstruct flow of exhaust gases through the timing window and into the exhaust port.

13. The apparatus of claim 7 wherein the engine is made substantially from aluminum and the sleeve is made from steel.

* * * * *

UNITED STATES PATENT AND TRADEMARK OFFICE

CERTIFICATE OF CORRECTION

PATENT NO. : 5,438,825

DATED : August 8, 1995

INVENTOR(S) : Bloemers

It is certified that error appears in the above-indentified patent and that said Letters Patent is hereby corrected as shown below:

Title page, item [73], Assignee: should read --WCI Outdoor Products, Inc., Cleveland, Ohio --.
Title page, col. 2, before Abstract, insert --Attorney, Agent or Firm, Pearne, Gordon, McCoy & Granger--.
Title page, item [57], Abstract, line 1, col. 2, delete "prooducing" and insert --producing--.
Column 6, line 31, after "surface" insert --of--.
Column 8, line 42, Claim 5, line 5, delete "the, " and insert --the--.

Signed and Sealed this

Ninth Day of April, 1996

Bruce Lehman

*Attest:*

BRUCE LEHMAN

*Attesting Officer*

*Commissioner of Patents and Trademarks*